United States Patent [19]

Steinki et al.

[11] 4,402,276

[45] Sep. 6, 1983

[54] METHOD OF CONTROLLING THE SPEED OF ROTATION OF THE DRIVE MOTOR OF AN EMBROIDERY, STITCHING OR SEWING MACHINE

[75] Inventors: Karl Steinki, Meerbusch; Hans-Gerd Ripkens, Goch, both of Fed. Rep. of Germany

[73] Assignee: Maschinenfabrik Carl Zangs Aktiengesellschaft, Krefeld, Fed. Rep. of Germany

[21] Appl. No.: 264,740

[22] Filed: May 18, 1981

[30] Foreign Application Priority Data

May 31, 1980 [DE] Fed. Rep. of Germany ..... 3020721

[51] Int. Cl.[3] ..... D05B 69/18; D05B 21/00

[52] U.S. Cl. ..... 112/262.3; 112/121.12

[58] Field of Search ..... 112/121.12, 158 E, 277, 112/220, 221, 314, 315, 262.1, 262.3, 266.1

[56] References Cited

U.S. PATENT DOCUMENTS 4,108,093 8/1978 Watanabe et al. ..... 112/220 X 4,221,176 9/1980 Besore et al. ..... 112/121.12

*Primary Examiner*—Peter P. Nerbun

*Attorney, Agent, or Firm*—Martin A. Farber

[57] ABSTRACT

A method for controlling the speed of rotation of the drive motor for the movement of the needle bar(s) on embroidery, stitching or sewing machines, in which the relative movement between the material being worked and the needle bars is produced by motors which are separate from the needle bar drive. In order to obtain the highest possible output without excessive accelerations and abrupt changes in acceleration in the needle bar drive, the lengths of the next several stitches are read from the data carrier stored sequentially and cyclically measured, and the speed of rotation of the needle-bar drive motor is adapted in each case to the highest value measured. The number of sequentially stored stitches is in this connection selected as low as possible, corresponding to the inertia of the drive of the needle bars.

13 Claims, 1 Drawing Figure

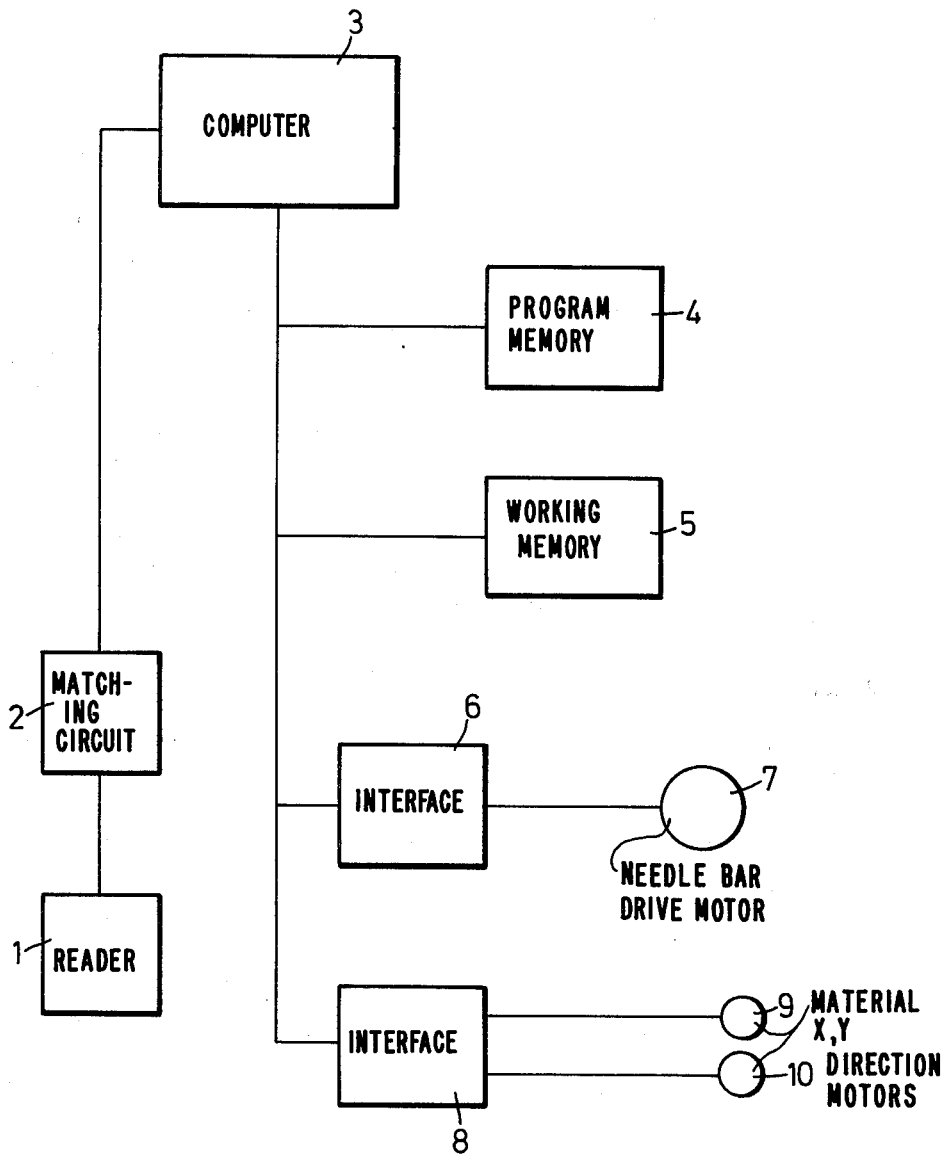
3
COMPUTER
PROGRAM MEMORY
4
WORKING MEMORY
5
MATCH-ING CIRCUIT
2
6
INTERFACE
7
NEEDLE BAR DRIVE MOTOR
1
READER
INTERFACE
9
MATERIAL X,Y DIRECTION MOTORS
10
8

METHOD OF CONTROLLING THE SPEED OF ROTATION OF THE DRIVE MOTOR OF AN EMBROIDERY, STITCHING OR SEWING MACHINE

The present invention concerns a method of controlling the speed of rotation of the drive motor for moving the needle bar or bars of embroidery, stitching or sewing machines in which the relative movement between the material to be worked and the needle bars is effected by motors which are separate from the needle-bar drive.

In automatic embroidery machines of high embroidery output it is known to automatically switch the speed of the drive motor for the movement of the needle bars to a lower embroidery speed in order to obtain good precision for the embroidering with stitches of long length. In this way, uncontrolled movements and oscillations of the frame which holds the material being embroidered are avoided. Such uncontrolled movements and oscillations would occur if stitches of large length for which the embroidery-frame drive does not have sufficient time were to be carried out with a high speed of drive of the machine. Furthermore, breaking of embroidery needles which are still present within the material due to too early a movement of the frame is prevented.

In the known designs of automatic embroidery machines, the switching from a high speed producing, for instance, 800 stitches a minute to a lower speed of, for instance, 520 stitches per minute takes place as soon as the length of stitch, which is for instance between 0.1 and 12.7 mm, exceeds a value of 6 mm. The reduction in the speed is obtained by means of two-speed motors.

In these known automatic embroidery machines it is possible to obtain sufficient precision of embroidery even with large lengths of stitch, but the two-speed motors, which are controlled, for instance, by a computer, produce substantial acceleration upon each switching, which leads to a strong stressing of the parts of the embroidery machine.

The object of the present invention is to provide a method for controlling the speed of the drive motor for the movement of the needle bar or bars on embroidery, stitching or sewing machines, in which the relative movement between the material being worked and the needle bars is produced by motors which are separate from the needle bar drive and with which method, with due consideration of the next stitches to be produced, the highest possible output is obtained on the hand, without excessively high accelerations and, on the other hand, without abrupt changes in acceleration in the needle-bar drive.

This objective is achieved by the invention, in the manner that the data carrier is scanned as to the stitch lengths of the next several stitches to be performed, which length information is stored sequentially and measured cyclically and the rotational speed of the needle-bar drive motor is adjusted in each case to the highest value measured.

By this method in accordance with the invention the result is obtained that the drive speed of the needle bars of embroidery, stitching or sewing machines is adjusted to the maximum possible output as a function of the lengths of the stitches to be executed next, in the manner that the stitch lengths of the next several stitches, as scanned (or read) from the data carrier, are sequentially stored and cyclically measured so that the speed of rotation of the drive motor for the needle bar drive can be continuously controlled in such a way that respectively at each time the necessary time is available for the relative movement between the material being worked and the needle bars, which movement depends on the corresponding stitch length, yet on the other hand there are no standstill times due to a drive which is too slow with respect to the corresponding stitch length. In this way, clean embroidery is obtained even with maximum output.

The method of the invention thus utilizes the maximum capability of the drives in each case for the movement of the material to be worked and, on the other hand controls the drive of the needle bars as a function of the time required for these movements, which time is dependent upon the prevailing of stitch length at the time. The speed of the needle bar drive is in this case adjusted continuously to the maximum possible output at the time, whereby the advantage furthermore is obtained that abrupt changes in the invention resides furthermore in the needle bar drive motor being developed as a three-phase motor, the sewing work, are avoided. Furthermore, due to these continuous adjustments, both the drives and all of the devices for producing the relative movement between the needles and the material to be worked are subjected only to slight stresses so that all parts of this construction can be made particularly light and experience only slight wear.

In accordance with another feature of the invention, the number of sequentially stored stitches is selected as low as possible, corresponding to the inertia of the drive of the needle bars. In this way there is obtained a high precision of adaptation of the drive speed of the needles to different lengths of stitches, with due consideration of the highest possible speed of change of the needle bar drive.

In order to avoid abrupt changes in speed which would result in an imprecise stitch pattern, the speed of rotation of the needle-bar drive motor can be established as an analog signal, for instance voltage or current, and the rate of change of the speed of rotation can be limited by an adjustable damping member, for instance a low-pass filter. The possibility of adjusting the damping member furthermore provides a possibility of adaptation to different embroidery jobs such as present, for instance, when working thin silk threads and thick wool yarns. Finally, this further development considerably reduces the unavoidable wear.

One possible embodiment in accordance with the invention consists furthermore in the fact that the needle-bar drive motor is developed as a three-phase motor the speed of rotation of which is dependent directly on the frequency of a power supply which in its turn is controlled by the result of each cyclic measurement. With this development of the method of the invention, it is possible to dispense with the use of a control circuit for comparison of actual and desired speeds of rotation, thus resulting in a structurally favorable embodiment.

As a further development of the invention, the control of the current supply for the needle bar drive motor can be effected by a frequency produced in a computer as a function of the result of the cyclic measurement, so that when a computer is used at the same time it effects the frequency control of the three-phase motor.

A block diagram of one preferred embodiment of a control for an embroidery machine for carrying out the method of the invention is shown by way of example as the sole FIGURE in the accompanying drawing.

The stitch sequence based on which the material is to be stitched, which sequence is stored in an information carrier, for instance a punched tape or magnetic tape, is read in a reader 1. The stitch sequence read, which comprises in particular the movement of the material being embroidered in two directions perpendicular to each other (x and y directions), is fed via a matching or adjustment circuit 2 to a computer 3.

This computer 3 operates with a program memory 4 and a working memory 5 in order to obtain on the one hand instructions for given stitch sequences and on the other hand to have the possibility of storing calculated intermediate results. From the computer 3, control signals are fed as a function of the data from the program memory 4 and the working memory 5 on the one hand via an interface 6 to the needle bar drive motor 7 and on the other hand via an interface 8 to two motors 9 and 10 which effect the movements in x and y directions of the material being embroidered.

The program, which is adapted in the program memory 4 to the specific type of automatic embroidery machine, causes the reader 1 sequentially to scan or interrogate the stitch lengths of several stitches from the data carrier and feed (enter) same as a series of, for instance, twenty stitches via the computer 3 into the working memory 5. This series of twenty stitches is examined by the computer 3 to note the largest stitch length contained in the series in accordance with instructions from the program memory 4. This value of the longest stitch length stored in the working memory 5 is processed by the computer 3 in order to control the needle bar drive motor 7, the speed of rotation of this needle bar drive motor 7 being controlled such that, taking into consideration the movement of the material being embroidered, which movement is dependent on the stitch length, and the time resulting therefrom for the displacement of the embroidery frame, the fastest possible movement of the needle is effected. The needle-bar drive motor 7 is thus controlled as a function of the longest length to be executed at each time of the stitches of the series of stitches stored in the working memory 5. The movement in the x and/or y direction of the frame which carries the embroidery material always takes place at a predetermined speed.

After the execution of a single stitch in each case, the series stored in the working memory 5 is decremented (reduced) by the stitch which has been executed and supplemented via the reader 1 and computer 3 by the next stitch from the data carrier. After each supplementation, the series is again examined for the longest stitch length of this new series, which in its turn then serves to control the needle-bar drive motor 7. A sequence of short stitch lengths thus results in an increase in the operating speed of the needle-bar drive motor 7 and thus, with utilization of the existing possibilities, in a considerable increase in output of the automatic embroidery machine.

In order to obtain the best possible adaptation to the different lengths of stitches, the number of stitches stored in each case in the working memory 5 is kept as small as possible, in which connection the inertia of the needle bar drive upon the change of its speed of rotation must be taken into consideration. This inertia is dependent on the type of machine, for instance on the number of needle bars and the nature of their drive.

In the interface 6 for matching the needle bar drive to the control commands given by the computer 3, the speed parameter can be formed, for instance, as an analog signal, for instance voltage or current. In order to avoid abrupt changes in speed which would lead to an unsatisfactory embroidery pattern and extensive wear, the rate of change of the speed of rotation of the needle bar drive motor 7 can be limited by a damping member in the path of the analog signal, for instance by a low-pass filter. This damping member is advantageously adjustable, since the permissible rate of change is dependent not only on the type of machine but also on the specific embroidery task, for instance on the yarn to be worked. While the requirements as to the precision of the embroidery and thus the limitation of the rate of change are high in the case of fine yarns, a higher rate of change can be permitted when working with thick yarns, for instance woolen yarns.

The needle drive motor 7 can alternatively be a three-phase motor, the speed of rotation of which is dependent directly on the frequency of a current supply which in its turn is controlled by the result of each cyclic measurement. In this way, no control circuit for comparison of the actual and desired speeds is required so that a structurally favorable control of the speed of the needle-bar drive motor 7, which is of low sensitivity to disturbance, is obtained. In the embodiment shown, this frequency is produced in the computer 3. It can also be produced in some other manner, for instance by a frequency synthesizer, since the computer 3 is not absolutely necessary for carrying out the method described above.

What is claimed is:

1. In a method of controlling the speed of rotation of a drive motor for movement of at least one needle bar on embroidery, stitching or sewing machines during operation, in which the relative movement between the material being worked and the needle bar(s) is effected by motors separate from the needle bar drive, wherein needle speed is selected in dependency on stitch lengths, the latter being operatively stored in a data carrier therefor, the improvement comprising the steps of cyclically at each instant:

sequentially storing individual lengths of a plurality of succeeding stitches from the data carrier;

scanning the individual lengths of said respective plurality of stored lengths and determining a longest of said lengths, controlling the speed of rotation of the drive motor for the needle bar in each instant to the respective longest length determined.

2. The method according to claim 1, wherein said respective plurality of sequentially stored stitches is selected as low as possible, proportionally to the inertia of the needle bar drive.

3. The method according to claim 1 or 2, wherein the speed of rotation of the drive motor for the needle bar is predetermined as an analog signal, and limiting the rate of change of said speed of rotation by variable damping.

4. The method according to claim 3, wherein the analog signal is a voltage signal.

5. The method according to claim 3, wherein the analog signal is a current signal.

6. The method according to claim 3, wherein the variable damping is performed by a low-pass filter.

7. The method according to claim 1, wherein the drive motor for the needle bar is a three-phase motor and said speed of rotation thereof is dependent directly on the frequency of a current supply therefor, controlling the current supply and thus said first-mentioned controlling step by the result of each respective cyclic determination.

8. The method according to claim 7, wherein the step of controlling the current supply for the drive motor is performed by a frequency which is produced in a computer as a function of the result of said each respective cyclic determination.

9. The method according to claim 1, wherein said respective plurality is the same number for each cycle.

10. The method according to claim 1, wherein each succeeding cycle contains one additional succeeding stitch and no longer contains a last executed stitch.

11. The method according to claim 1, wherein after the execution of each respective stitch the plurality of succeeding stitches that has been stored is reduced by said respective stitch which has been executed and supplemented by a next successive stitch from the data carrier after the last stitch of the previous plurality of succeeding stitches.

12. In a method of controlling the speed of rotation of a drive motor for movement of at least one needle bar on embroidery, stitching or sewing machines during operation, in which the relative movement between the material being worked and the needle bar(s) is effected by motors separate from the needle bar drive, and wherein the stitch lengths of stitches to be executed are operatively stored in a data carrier therefor, the improvement comprising the steps of, selecting the data carrier which does not contain needle speed information for movement of the needle bar(s), cyclically at each instant for executing an instant stitch:

sequentially storing from the data carrier individual stitch lengths of a predetermined plurality of not yet executed succeeding stitches defining a sequence of sequentially immediately following stitches including and starting with the instant stitch to be executed;

scanning the respective individual lengths of said predetermined plurality of stored stitch lengths and determining the longest stitch length in said predetermined plurality of stitches scanned in said sequence, correlating the speed of rotation of the drive motor for the needle bar to the longest stitch length determined in said predetermined plurality of stitches during execution of the instant stitch.

13. The method according to claim 12, wherein after the execution of each single respective stitch the predetermined plurality of succeeding stitches that has been stored is reduced by said respective stitch which has been executed and supplemented by a next successive stitch from the data carrier beyond the last stitch in the sequence of the previous predetermined plurality of succeeding stitches.

* * * * *